US010172397B2

(12) United States Patent
Biscuiti

(10) Patent No.: US 10,172,397 B2
(45) Date of Patent: Jan. 8, 2019

(54) PROTECTIVE SHIRT

(71) Applicant: Nicole Biscuiti, Delray Beach, FL (US)

(72) Inventor: Nicole Biscuiti, Delray Beach, FL (US)

( * ) Notice: Subject to any disclaimer, the term of this patent is extended or adjusted under 35 U.S.C. 154(b) by 0 days.

(21) Appl. No.: 14/577,354

(22) Filed: Dec. 19, 2014

(65) Prior Publication Data

US 2015/0173435 A1 Jun. 25, 2015

Related U.S. Application Data

(60) Provisional application No. 61/918,831, filed on Dec. 20, 2013.

(51) Int. Cl.
*A41D 13/00* (2006.01)
*A41D 13/05* (2006.01)

(52) U.S. Cl.
CPC ..... *A41D 13/0512* (2013.01); *A41D 13/0518* (2013.01); *A41D 13/0556* (2013.01)

(58) Field of Classification Search
CPC . A63B 71/12; A63B 71/08; A63B 2071/1208; A41D 13/0518; A41D 13/015; A41D 13/0512; A41D 13/0015; A41D 13/0002; A41D 13/05; A41D 13/0556
USPC ..... 2/463, 267, 113, 255, 272
See application file for complete search history.

(56) References Cited

U.S. PATENT DOCUMENTS 576,880 A * 2/1897 McNutt ..... A41D 1/04 2/113
714,079 A 11/1902 Whitley
1,489,080 A 4/1924 Lee
1,970,130 A 8/1934 Dickenson
3,257,666 A * 6/1966 Hoffman ..... A41D 13/0151 2/267
3,561,009 A * 2/1971 Huggins ..... A41D 1/04 2/122

(Continued)

FOREIGN PATENT DOCUMENTS

FR 2787298 6/2000
WO 2009018806 2/2009

OTHER PUBLICATIONS

"Throat Collar—Wrap around" Mazon; https://www.justhockey.com.au/index.php?action=prodcatalogue&form_name=view_product&category_id=32&product_id=339&pageID=8133§ionID=0 Last visited on Aug. 27, 2013.

(Continued)

*Primary Examiner* — Timothy K Trieu
(74) *Attorney, Agent, or Firm* — Fleit Gibbons Gutman Bongini Bianco PL; Jon Gibbons

(57) ABSTRACT

A protective shirt includes a chest portion made of garment material including a lining on a side of the chest portion that is closest to a wearer of the protective shirt. At least one layer of neoprene is securely fastened to the lining. The at least one layer of neoprene extends from a left side of the chest portion to a right side of the chest portion, and is located at an area of the chest portion nearest to a clavicle of a wearer of the protective shirt. The at least one layer of neoprene includes a plurality of spaced-apart segments of the at least one layer of neoprene. The protective shirt includes a neoprene neck pad. Embodiments of the protective shirt include cap-sleeve, short sleeve, long sleeve, sleeveless and tank top versions. In one embodiment, the garment material includes nylon and spandex.

21 Claims, 13 Drawing Sheets

(56) References Cited

U.S. PATENT DOCUMENTS 3,855,632 A * 12/1974 Davis ..... F41H 1/02 2/2.5
4,397,636 A * 8/1983 Ganshaw ..... A41D 13/0125 2/16
4,425,667 A * 1/1984 Harrison ..... A41D 13/0153 2/16
4,507,801 A 4/1985 Kavanagh et al.
4,686,710 A 8/1987 Martson et al.
4,800,593 A * 1/1989 Ruffner ..... A41D 13/015 2/102
5,048,125 A * 9/1991 Libertini ..... A63B 21/065 2/79
5,101,511 A * 4/1992 Elverskog ..... A41D 13/05 2/102
D382,093 S 8/1997 Winfree
5,675,844 A 10/1997 Guyton et al.
5,758,363 A 6/1998 Winfree
5,769,688 A 6/1998 Holliday
D409,818 S * 5/1999 Shaffer ..... D2/731
6,000,064 A * 12/1999 Alcone ..... A41D 27/20 2/122
6,079,056 A 6/2000 Fogelberg
6,083,080 A * 7/2000 Lawson ..... A41C 3/0057 450/39
D441,517 S * 5/2001 Shaffer ..... D2/717
6,584,619 B1 * 7/2003 Macri ..... A41D 13/015 2/455
6,748,601 B2 6/2004 LaShoto et al.
6,862,751 B1 3/2005 Wattenbarger et al.
7,100,216 B2 9/2006 Matechen et al.
7,739,753 B2 6/2010 Jankowski
D674,576 S 1/2013 Johnson
8,997,267 B2 * 4/2015 Skottheim ..... A41D 13/0153 2/102
2003/0167560 A1 * 9/2003 LaShoto ..... A41D 13/015 2/463
2005/0081277 A1 4/2005 Matechen et al.
2006/0277647 A1 * 12/2006 Dobkin ..... A41D 13/05 2/69
2007/0155283 A1 7/2007 McQueer
2008/0313793 A1 * 12/2008 Skottheim ..... A41D 13/0153 2/461
2013/0239309 A1 * 9/2013 Webb ..... A41D 13/012 2/464
2015/0189926 A1 7/2015 Bunting
2015/0189927 A1 7/2015 Bunting

OTHER PUBLICATIONS

"Demon Snow Skinn Impact Top—Women's"; http://www.dogfunk.conn/demon-snow-skinn-high-impact-top-womens . Last visited on Aug. 27, 2013.

"Easton Youth Torso-Tection Shirt A164190"; http://www.directsports.com/catalog/item/Apparel/Easton/2962.html Last visited on Aug. 27, 2013.

"McDavid Longsleeve HexPad Shirt"; http://www.helmetsandarmor.com/mcdavid-longsleeve-hexpad-shirt.html Last visited on Aug. 27, 2013.

* cited by examiner

100

100

100

100

FIG. 15
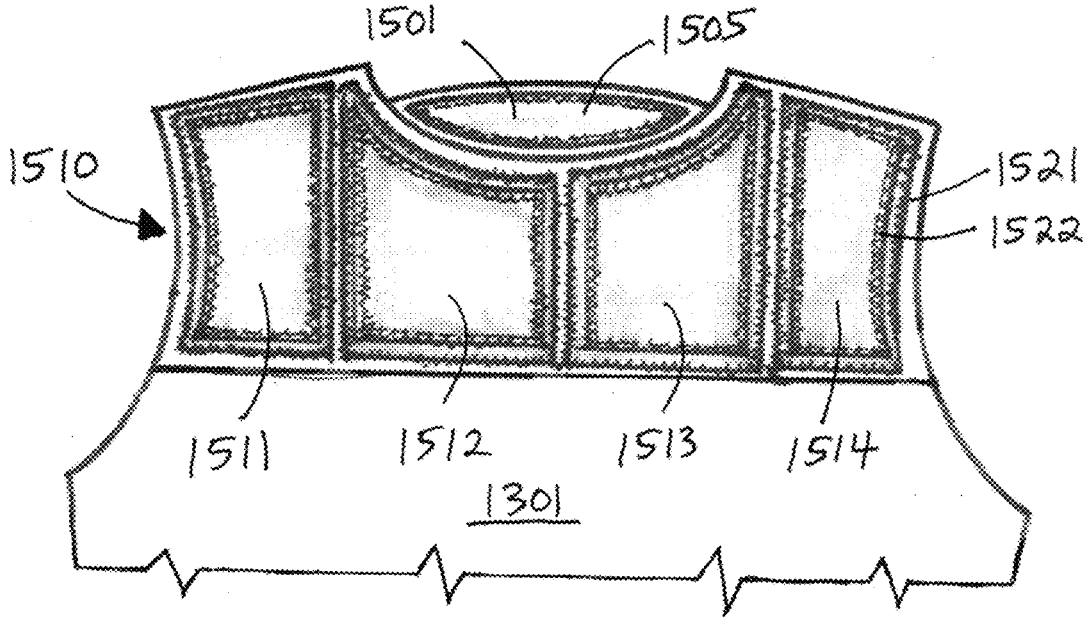
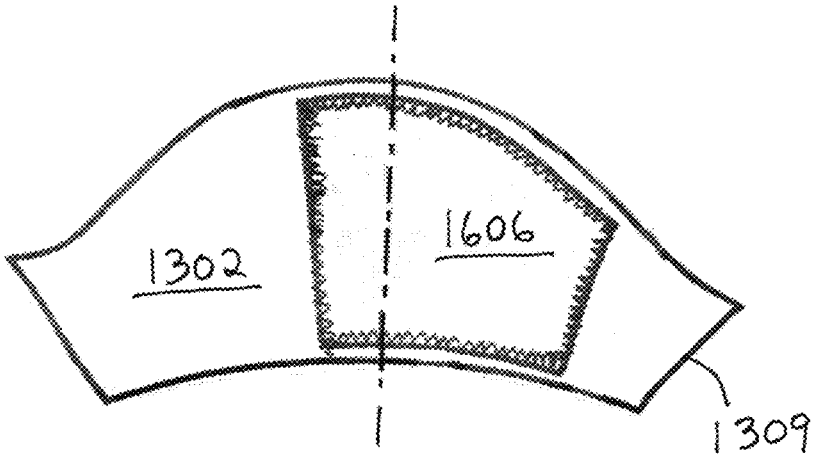
FIG. 16

FIG. 19
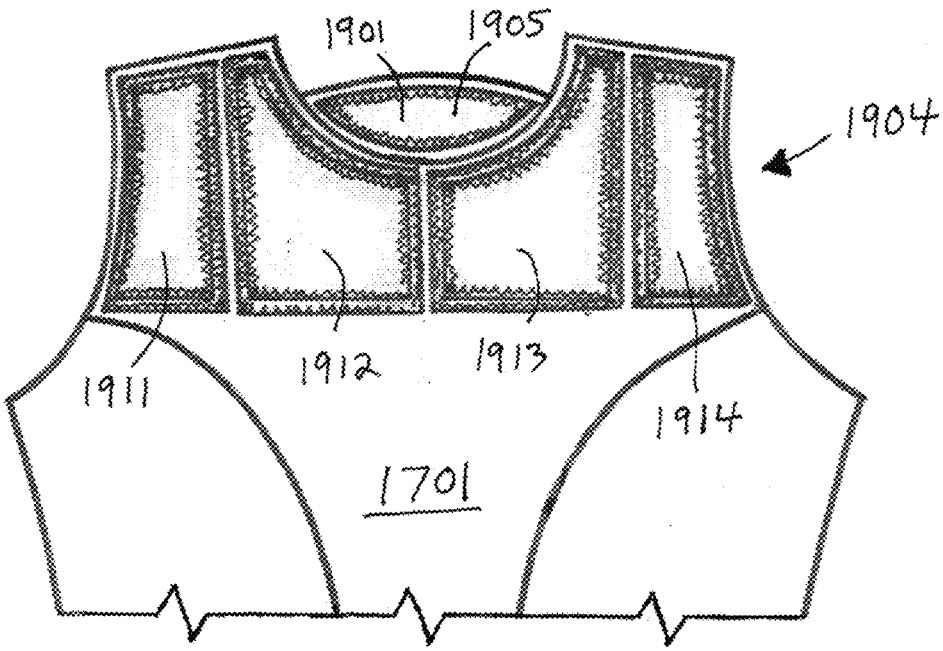
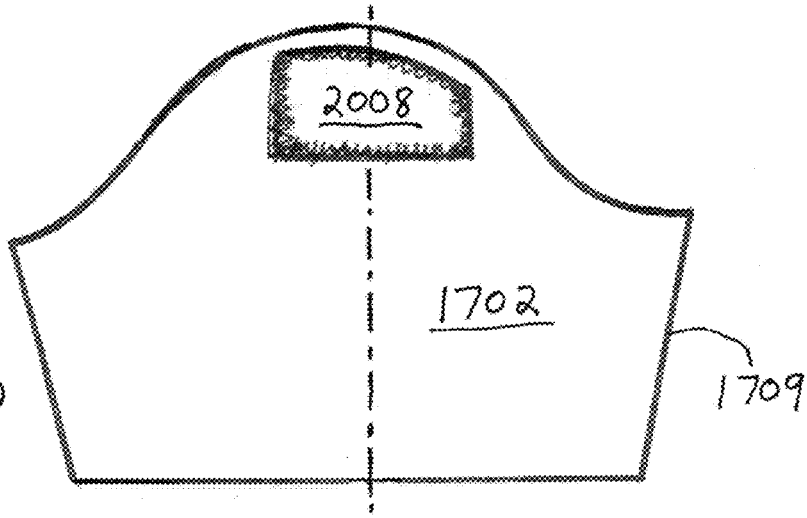
FIG. 20

PROTECTIVE SHIRT

BACKGROUND

Field

This invention relates generally to apparel and more particularly to shirts with a device for protection from the application of force against a part of the body of a wearer.

Related Art

Some weight lifting athletes, especially female weight lifting athletes, when using barbells in a front rack position, sustain bruising and irritation of the shoulder area including the clavicle area and/or the collarbone area. This can lead to severe discomfort including redness, bruising, bleeding in the shoulder area, and calcification of the collarbone.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

FIG. 15 is a plan view of inside of a chest portion of the cap-sleeve protective shirt of FIG. 13, showing padding.

FIG. 16 is a plan view of inside of a sleeve portion of the cap-sleeve protective shirt of FIG. 13, showing padding.

FIG. 19 is a plan view of inside of a chest portion of the short-sleeve protective shirt of FIG. 17, showing padding.

FIG. 20 is a plan view of inside of a sleeve portion of the short-sleeve protective shirt of FIG. 17, showing padding.

DETAILED DESCRIPTION

As required, detailed embodiments of the present invention are disclosed herein; however, it is to be understood that the disclosed embodiments are merely examples of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure and function. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

Disclosed herein is a protective shirt 100 known as "Chestee". The protective shirt 100 is designed for a female athlete; however, it is foreseeable that the protective shirt can be worn by a male athlete. The protective shirt 100 may be used for working out and weight lifting. The protective shirt 100 can protect a user, i.e., a person who wears the shirt, from abrasions at a shoulder area, including a clavicle/collarbone area, during exercises such as "squat cleans", "power cleans", "front squat", "push press", "push jerk", "split jerk", "thrusters" and "a front rack position".

Figure 1:
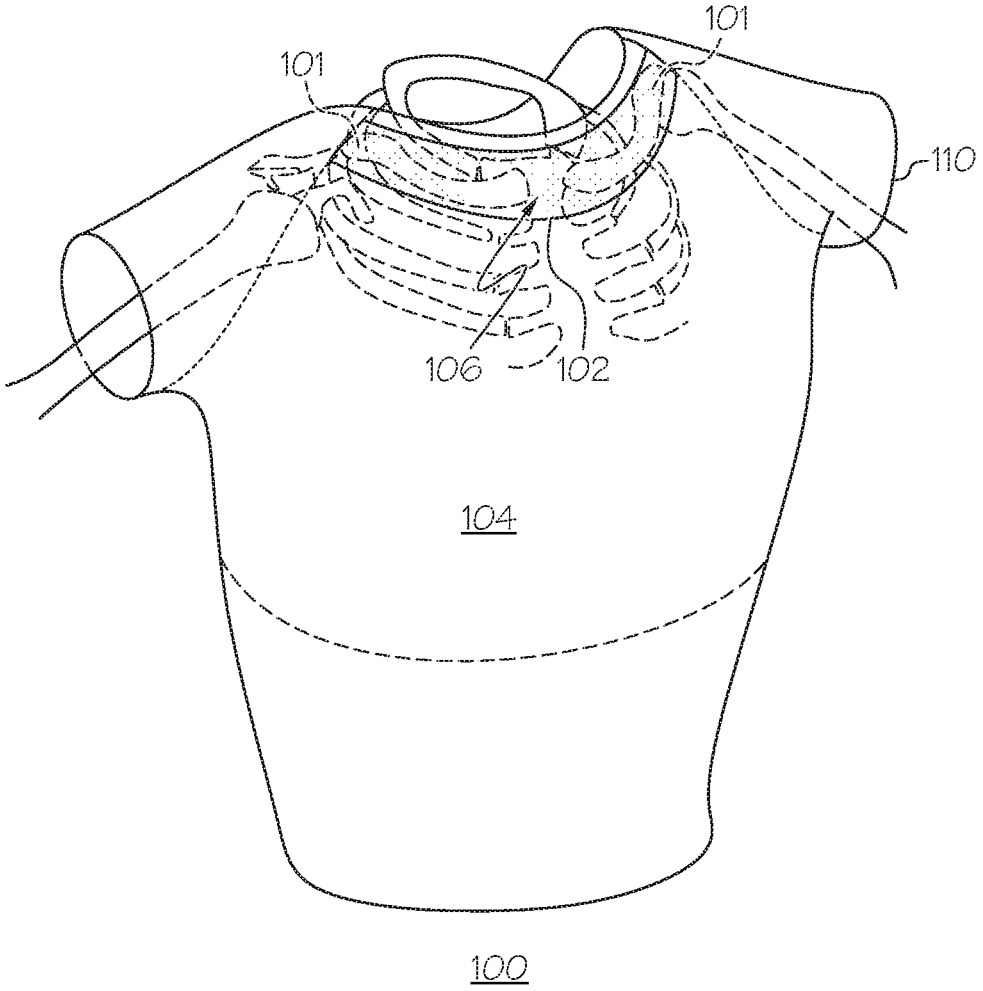
FIG. 1 is front view of a protective shirt, in accordance with one embodiment of the invention.

FIG. 1 is front view of the protective shirt 100 including a shirt and a guard, including cushioning, disposed on an outer surface of a front portion of the shirt at a clavicle/collarbone area 106, in accordance with one embodiment of the invention. The protective shirt 100 comprises one example of a built-in clavicle/collarbone guard 102 located on a front portion 104 of the protective shirt at the clavicle/collarbone area 106. By the term "built-in" it is meant that the clavicle/collarbone guard is part of the protective shirt. The protective shirt 100 includes a shirt 108 whose garment material can be made from any one or more of a variety of fibers, including a natural fiber, a synthetic fiber, and a combination of natural and synthetic fibers. Examples of such a synthetic fiber are nylon and spandex which is also known as elastane. In one embodiment, the fiber of the garment material is weaved as micro-mesh. In one example, the shirt 108 is a conventional shirt or a conventional shirt with a higher neckline. In one example, the guard 102 comprises flexible, built-in padding, or cushioning, 200 (see FIG. 2) made from synthetic rubber such as neoprene which is also known as polycloroprene, or other washable cushioning materials. At least one layer of neoprene extends from a left side of the chest portion to a right side of a chest portion of the protective shirt 100, and is located at an area of the chest portion nearest to a clavicle 101 of a wearer of the protective shirt. The guard 102 includes at least one instance of the cushioning 200 disposed on a surface of the shirt 108.

In another example, one or more pads are fastened, attached and/or sewn to both the inside and outside of the shirt 108 to form layers of cushioning. Fasteners, such as a VELCRO® fastener of Velcro Industries, N.V., of Willemstad, the Netherlands, can make the one or more layers of the material removable. Other non-removable fastening methods include adhesive and stitching or a combination of both. In one example, neoprene stitching is used. The example of the protective shirt 100 shown in FIG. 1 has short sleeves 110.

In still another example, padding is sewn into the shirt 108. In yet another example, the padding is located between the two layers of the fabric of the shirt 108.

Figure 2:
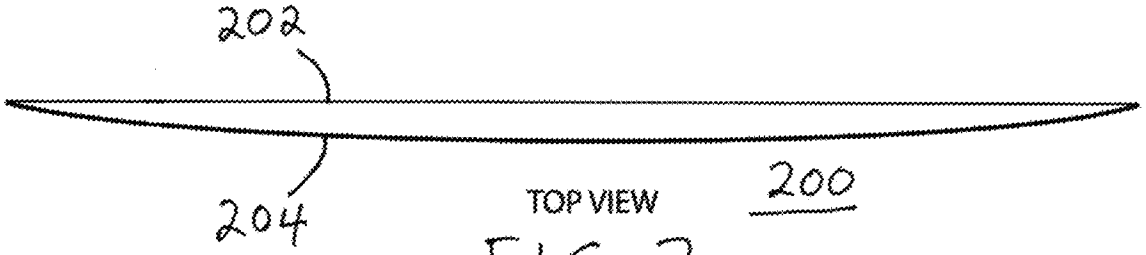
FIG. 2 is a top view of the one example of the cushioning.

FIG. 2 is a top view of the one example of the cushioning 200. The cushioning 200 has a first surface 202 that is approximately flat, and a second surface 204 that is tapered.

Figure 3:
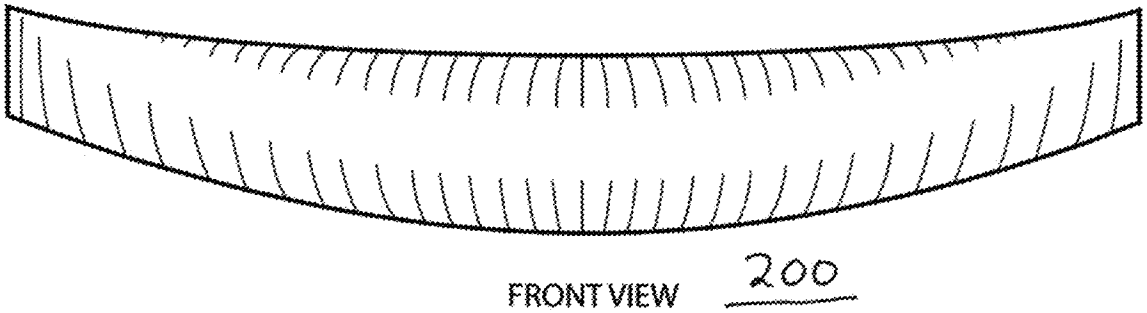
FIG. 3 is a front view of the one embodiment of the cushioning.

FIG. 3 is a front view of the one example of the cushioning 200. In the example shown in FIGS. 2 and 3, the cushioning 200 is, for example, soft plastic, neoprene or tapered molded foam. The tapering is such that the molded foam is thicker near the center of the shirt and thinner towards each sleeve. In another example, the tapering is from the top towards the bottom of the molded foam. This produces a thicker foam towards the neck and thinner foam away from the neck. A combination of tapering may be used. In still another, example, each section of padding is individually tapered to reflect a graduated edge. In yet other embodiments, a step-down tapering may be used.

Figure 4:
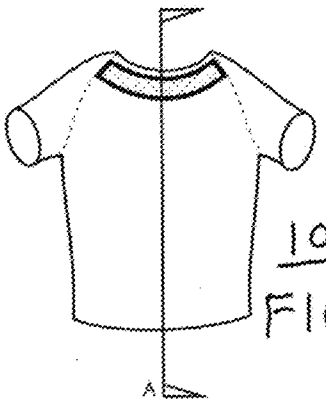
FIG. 4 front view of the protective shirt of FIG. 1 showing cut line A.

FIG. 4 front view of the protective shirt 100 showing cut line A at a center longitudinal axis illustrating the symmetry about the center longitudinal axis of the clavicle/collarbone guard 102.

Figure 5:
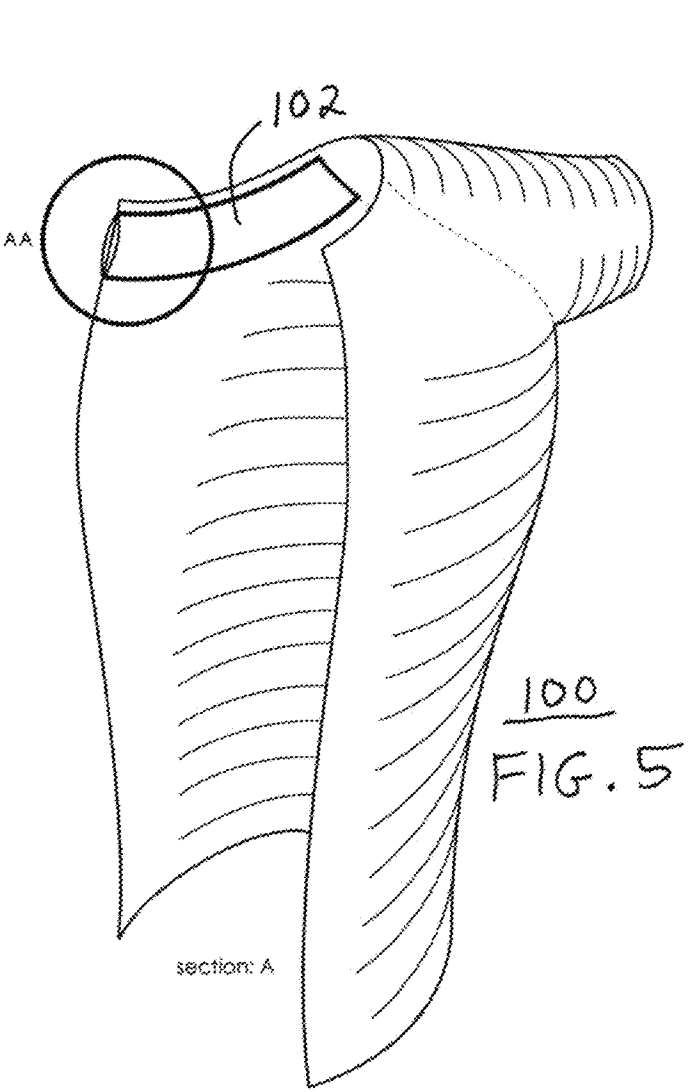
FIG. 5 is a sectional view, through cut line A, of the protective shirt of FIG. 1 illustrating one example the guard disposed on an inner surface of the front portion of the shirt at the clavicle/collarbone area, and showing a circle AA.

FIG. 5 is a sectional view, through cut line A, of the protective shirt 100 illustrating one example of the guard 102 disposed on the front portion 104 of the protective shirt 100 at the clavicle/collarbone area 106, and showing a circle AA.

Figure 6:
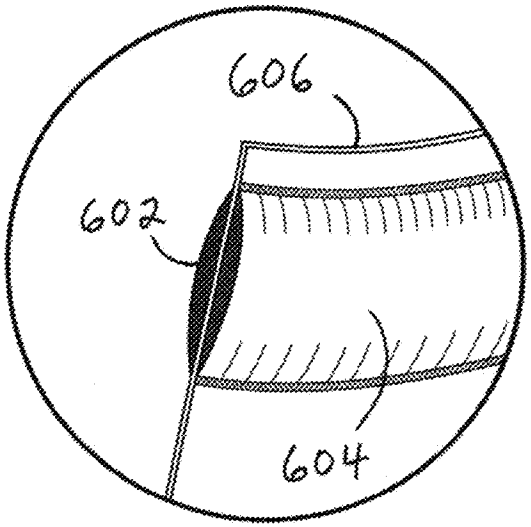
FIG. 6 is an enlargement of the area encompassed by the circle AA.

FIG. 6 is an enlargement of the area encompassed by the circle AA shown in FIG. 5. FIG. 6 shows that one example of the guard 102 comprises outer cushioning 602 disposed on an outer surface 1002 (see FIG. 10) of garment material 606 of the shirt 108, and inner cushioning 604 disposed on an inner surface 1004 (see FIG. 10) of the garment material of the shirt. The outer cushioning 602 and the inner cushioning 604 are resilient, springy, flexible and/or pliable materials. In one example, the inner cushioning 604 is softer than the outer cushioning 602.

In one example, the outer cushioning 602 and the inner cushioning 604 are made of a same material. In another example, the outer cushioning 602 and the inner cushioning 604 are made of different materials.

In one example, the outer cushioning 602 and the inner cushioning 604 have a same size. In another example, the outer cushioning 602 is larger than the inner cushioning 604. In still another example, the outer cushioning 602 is smaller than the inner cushioning 604.

In one example, the outer cushioning 602 and the inner cushioning 604 have a same shape. In another example, the outer cushioning 602 and the inner cushioning 604 have different shapes.

In one example, the outer cushioning 602 and the inner cushioning 604 are first sewn to each other, and then they are sewn to the outer surface 1002 of the garment material 606 of the shirt 108. In another example, the outer cushioning 602 and the inner cushioning 604 are first sewn to each other, and then they are sewn to the inner surface 1004 of the garment material 606 of the shirt 108.

Figure 7:
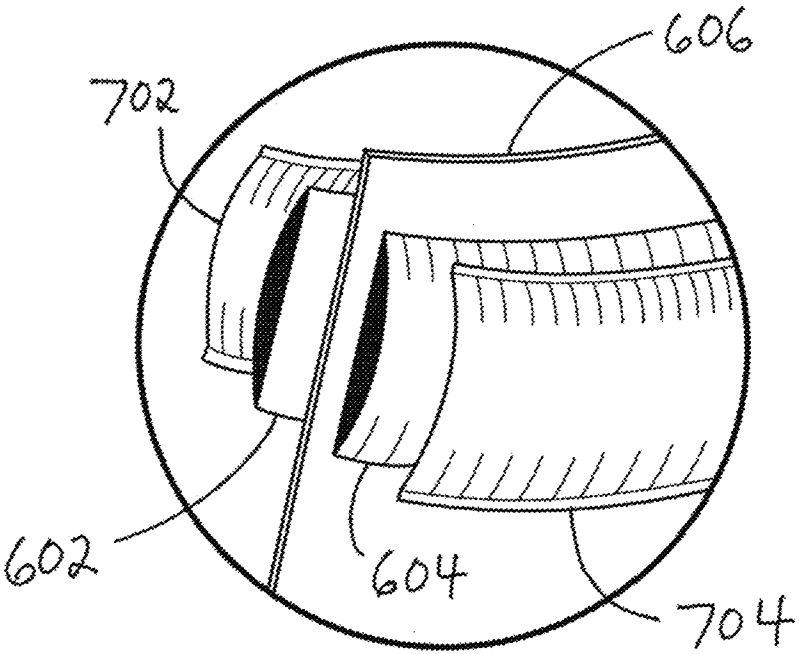
FIG. 7 is an exploded view of the area encompassed by the circle AA.

FIG. 7 is an exploded view of the area encompassed by the circle AA shown in FIG. 5. FIG. 7 shows, from left to right: first fabric 702 is sewn at its edges to the garment material 606 to secure the outer cushioning to the shirt 108; the outer cushioning 602; the garment material 606; the inner cushioning 604; and second fabric 704 is sewn at its edges to the garment material 606 to secure the inner cushioning to the shirt. In one example, the protective shirt 100 includes at least one of an outer pocket (not shown) for holding the outer cushioning 602 and an inner pocket (not shown) for holding the inner cushioning 604. In one example, the cushioning 200 slides into the outside pocket and/or the inside pocket. In such example, when the cushioning 200 is within the outside pocket and/or the inside pocket, the protective shirt 100 is implemented, and when the cushioning is not within the outside pocket and not within the inside pocket, the protective shirt 100 becomes a nearly conventional shirt.

Figure 8:
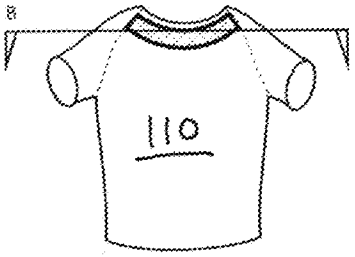
FIG. 8 is front view of the protective shirt of FIG. 1 showing cut line B.

FIG. 8 is front view of the protective shirt 100 showing the front portion 104 of the protective shirt and, showing cut line B.

Figure 9:
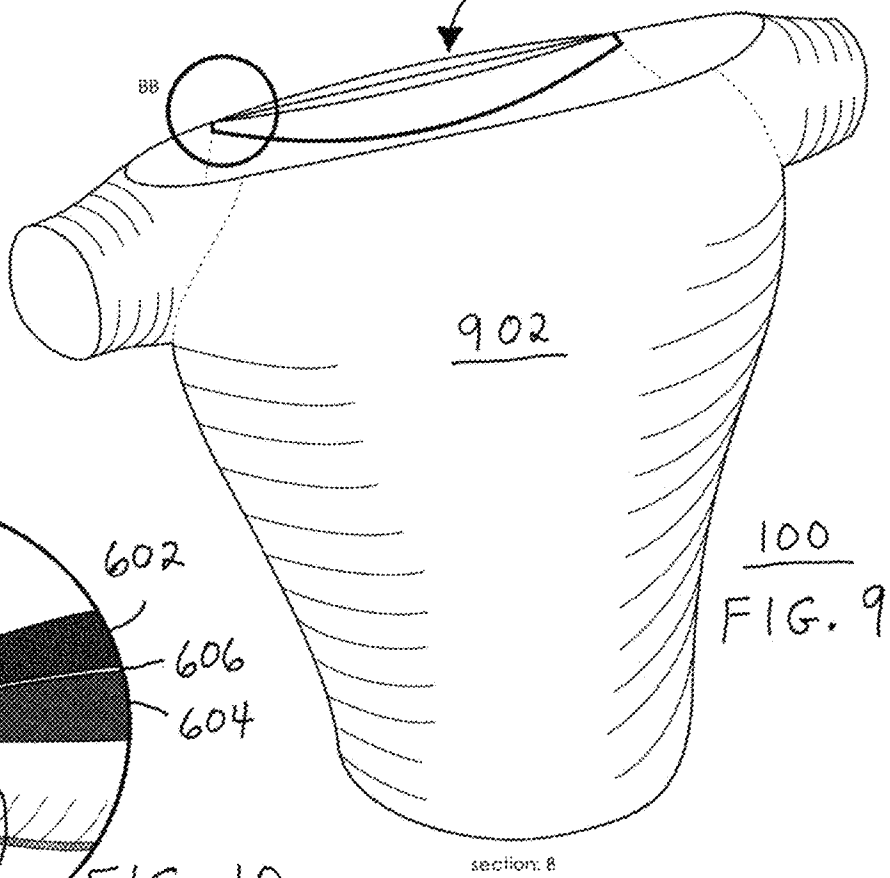
FIG. 9 is a sectional view, through cut line B, of the protective shirt of FIG. 1 illustrating the one example of the guard disposed on an inner surface of the front portion of the shirt at the clavicle/collarbone area, and showing a circle BB.

FIG. 9 is a sectional view, through cut line B, of the protective shirt 100 showing a back portion 902 of the protective shirt 100. FIG. 9 illustrates one example of the guard 102 disposed on the front portion 104 of the protective shirt 100 at the clavicle/collarbone area 106, and showing a circle BB.

Figure 10:
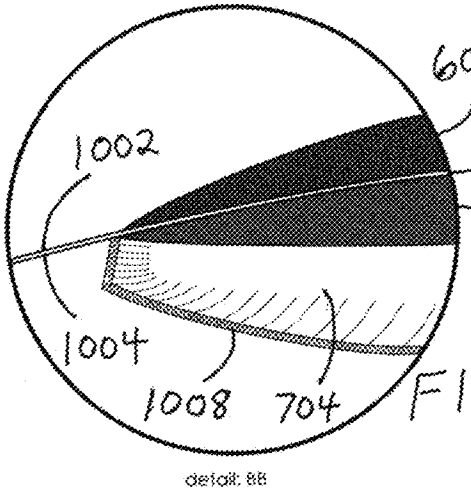
FIG. 10 is an enlargement of the area encompassed by the circle BB.

FIG. 10 is an enlargement of the area encompassed by the circle BB shown in FIG. 9. FIG. 10 shows, from top to bottom: the outer cushioning 602 disposed on the outer surface 1002 of the garment material; the garment material 606; the inner cushioning 604 disposed on the inner surface 1004 of the garment material; and the second fabric 704. Also shown is stitching 1008 at the edges of the second fabric 704.

Figure 11:
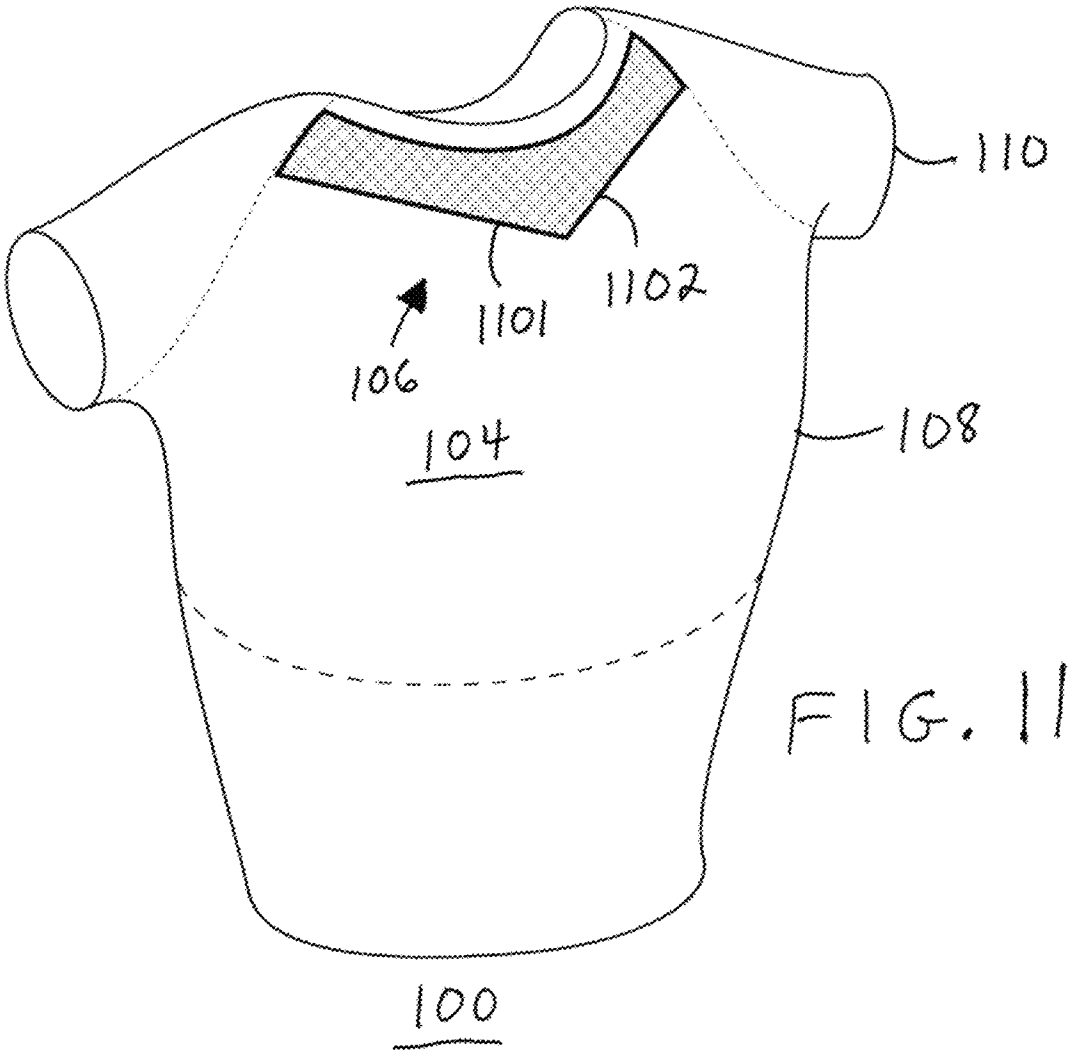
FIG. 11 is front view of the protective shirt including the shirt and another example of the guard.

FIG. 11 is front view of the protective shirt 100 including the shirt 108 with short sleeves 110, and another example of the outer cushioning 1101 and another example of a clavicle/collarbone guard 1102.

Figure 12:
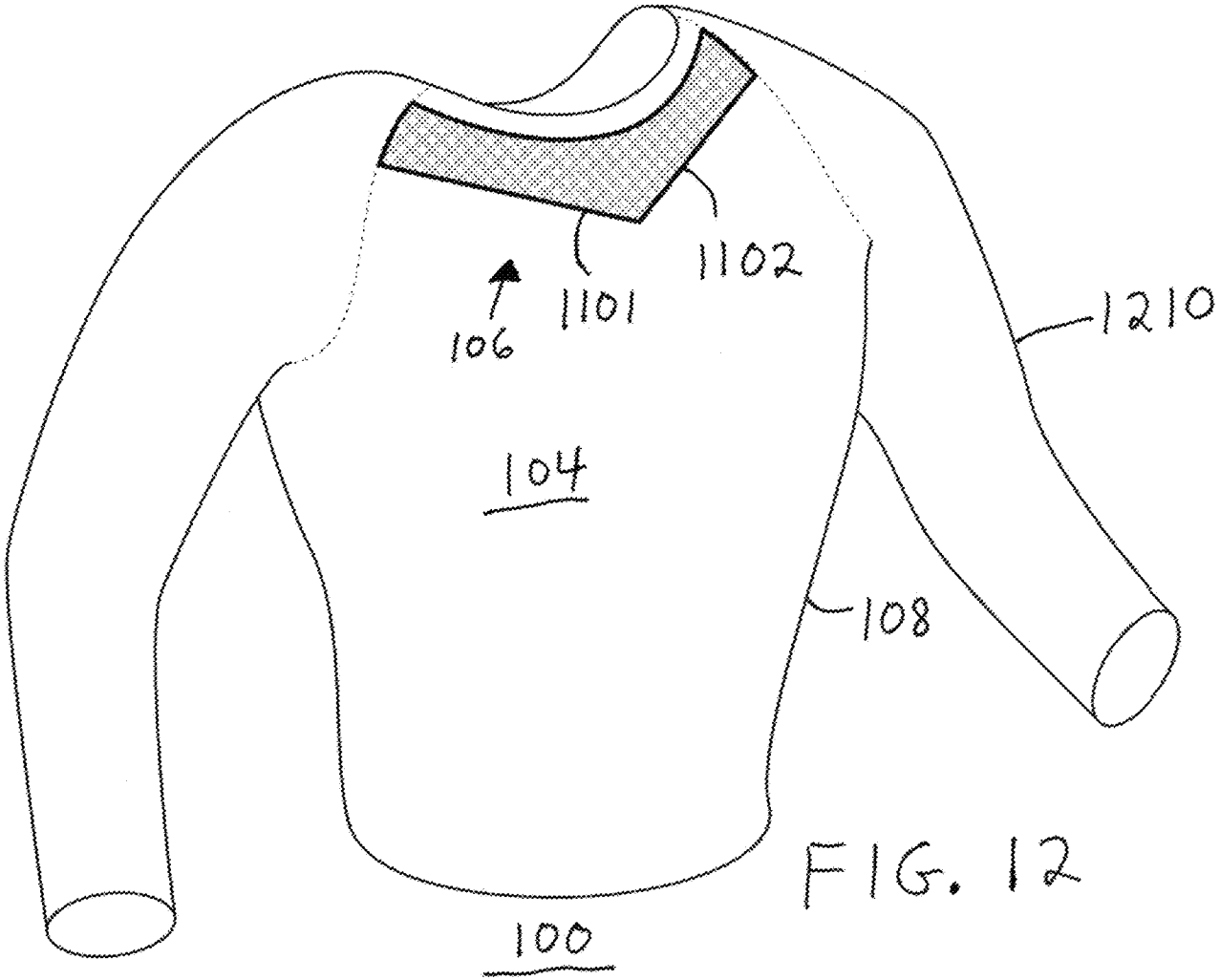
FIG. 12 is a long sleeve version of the protective shirt with the other example of the guard shown in FIG. 11.

FIG. 12 is a front view of the protective shirt 100, including the shirt 108 with long sleeves 1210, with the other example of the outer cushioning 1101 and the other example of the guard 1102.

In one example, the protective shirt 100 includes a shirt 108 made of garment material 606. The shirt 108 has an inner surface 1004 and an outer surface 1002. A front portion 104 of the shirt 108 includes a clavicle/collarbone area 106. Inner cushioning 604 is fastened to the inner surface 1004 at the clavicle/collarbone area 106, and outer cushioning 602 is fastened to the outer surface 1002 at the clavicle/collarbone area. The inner cushioning 604, the garment material 606 at the clavicle/collarbone area 106, and the outer cushioning 602 form a clavicle/collarbone guard 102. The protective shirt 100 protects the shoulder area of a wearer from injury. In one example, the guard 102 includes a plastic guard (not shown) on an outer surface of the outer cushioning 602.

In another example, the protective shirt 100 includes a torso portion having a front 104 with a clavicle/collarbone area 106, a back and a neck opening, a set of left and right arm sleeves which extend from and are directly joined to or integral with the torso portion such that the torso portion and the sleeves form a unitary shirt; and an inner cushioning portion 604 fastened on an inside clavicle/collarbone area 106 of the shirt 108; and an outer cushioning portion 602 fastened on an outside clavicle/collarbone area of the shirt, so as to form at least a three-layer system of the inner cushioning portion, the torso portion, and the outer cushioning portion. The three-layer system of the inner cushioning portion, the torso portion, and the outer cushioning portion protects the collarbone area of a user from injury.

Figure 13:
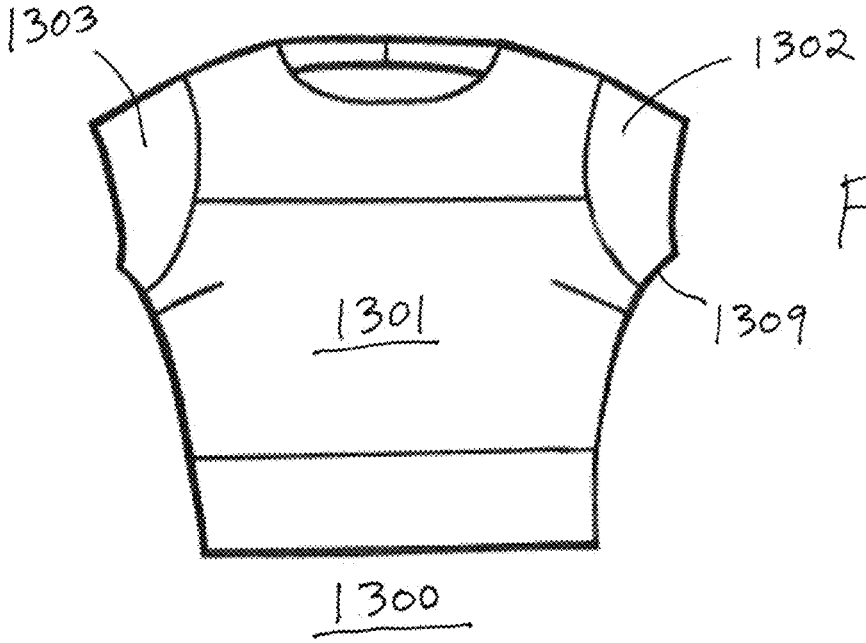
FIG. 13 is front view of a cap-sleeve protective shirt, in accordance with another embodiment of the invention.

FIG. 13 is front view of a cap-sleeve protective shirt 1300, in accordance with another embodiment of the invention. The cap-sleeve protective shirt 1300 comprises a chest portion 1301 and cap-sleeve portions 1302 and 1303. Cap-sleeve portion 1302 is a left sleeve. Cap-sleeve portion 1303 is a right sleeve. The chest portion 1301 comprises a garment material on an outside of the chest portion and a lining on an inside of the chest portion. By "inside" it is meant side of the chest portion 1301 that is closest to a wearer when the cap-sleeve protective shirt 1300 is worn. The cap-sleeve portions 1302 and 1303 comprise a garment material on an outside of each cap-sleeve portion and a lining on an inside of each cap-sleeve portion. In FIG. 13, a bottom-front edge 1309 of the cap-sleeve portion 1302 is indicated.

Figure 14:
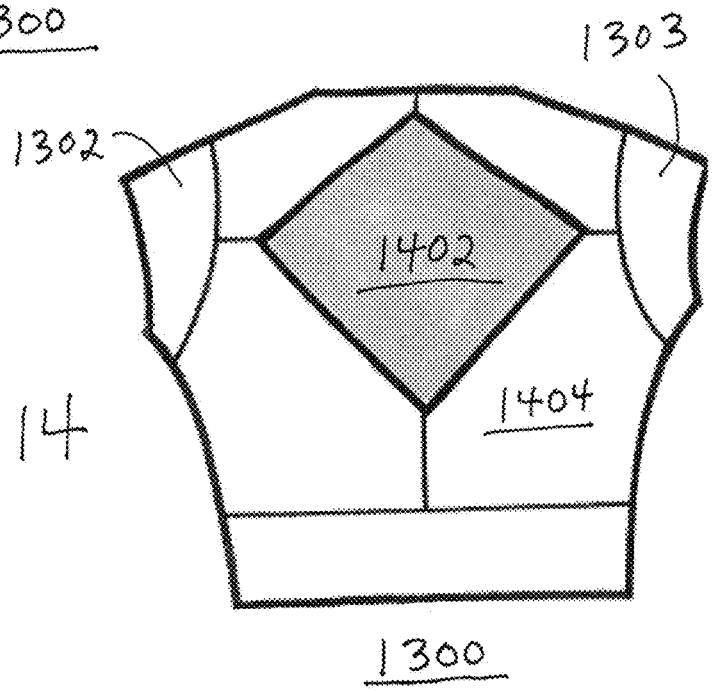
FIG. 14 is a rear view of the cap-sleeve protective shirt of FIG. 13.

FIG. 14 is a rear view of the cap-sleeve protective shirt 1300. The cap-sleeve protective shirt 1300 comprises a back portion 1404. The back portion 1404 comprises a garment material on an outside of the back portion and a lining on an inside of the back portion. The cap-sleeve protective shirt 1300 includes a cut-out portion 1402 in the garment material of the back portion 1404. In one embodiment, the cut-out portion 1402 is shaped as a diamond.

In one embodiment, the chest portion 1301, the cap-sleeve portions 1302 and 1303, and the back portion 1404 of the cap-sleeve protective shirt 1300 comprise a same garment material. The chest portion 1301, the cap-sleeve portions 1302 and 1303, and the back portion 1404 are sewn together to form a shirt, as shown in FIGS. 13 and 14. The cap-sleeve protective shirt 1300 is fully lined. In one embodiment, the cap-sleeve portions 1302 and 1303 and the back portion 1404 are fully lined with self-fabric, i.e., the same fabric as the fabric of the garment material, and the chest portion 1301 is fully lined with a different fabric. In another embodiment, the entire cap-sleeve protective shirt 1300 is fully lined with self-fabric. The garment material can be made from any one or more of a variety of fibers, including a natural fiber, a synthetic fiber, and a combination of natural and synthetic fibers. Examples of such a synthetic fiber are nylon and spandex. In one embodiment, the garment material consists of 87% nylon and 13% spandex. In one embodiment, the fiber of the garment material is weaved as micromesh.

FIG. 15 is a plan view of inside of the chest portion 1301 of the cap-sleeve protective shirt 1300 showing a neck pad 1501 and a clavicle/collarbone guard 1510. The neck pad 1501 is located near a top of the cap-sleeve protective shirt and the neck pad comprises a single segment and one layer of padding. The chest portion 1301 comprises a neck pocket 1505 formed by and between the garment material. The neck pad 1501 has a same shape as the neck pocket 1505 but is slightly smaller than the neck pocket. The neck pad 1501 is disposed within the neck pocket 1505. The neck pad 1501 is held in place by being tightly fitted within the neck pocket 1505.

The clavicle/collarbone guard 1510 is located below, and on both sides of the neck pad 1501. The clavicle/collarbone guard 1510 is located on a side of the chest portion 1301 that is closest to a wearer of the cap-sleeve protective shirt 1300. The clavicle/collarbone guard 1510 extends from approximately a left side of the chest portion 1301 to approximately a right side of the chest portion. In one embodiment, the clavicle/collarbone guard 1510 extends from approximately 0.25 inch from a left edge of the chest portion 1301 to approximately 0.25 inch from a right edge of the chest portion. The clavicle/collarbone guard 1510 extends from approximately the top of the cap-sleeve protective shirt 1300 to an imaginary line on the shirt that would typically be just below the collarbone area of a wearer when worn. In one embodiment, the clavicle/collarbone guard 1510 extends from approximately 0.25 inch from the top of the cap-sleeve protective shirt 1300 to the imaginary line on the shirt that would typically be just below the collarbone area of a wearer when worn.

The clavicle/collarbone guard 1510 is disposed inside the cap-sleeve protective shirt 1300. The clavicle/collarbone guard 1510 comprises a plurality of segments. In one embodiment, the clavicle/collarbone guard 1510 comprises four (4) segments 1511, 1512, 1513 and 1514. Each segment of the plurality of segments comprises at least one layer of padding. In one embodiment, each segment comprises a first layer 1521 of padding and a second layer 1522 of padding. The first layer 1521 of each segment is disposed on an inner side of the chest portion 1301. Each segment of the first layer 1521 is securely fastened to the chest portion 1301. In one embodiment, each segment of the first layer 1521 is stitched to the lining of the chest portion 1301. By stitching each segment of the first layer 1521 to the lining of the chest portion 1301 rather than to the outer fabric of the chest portion, no stitching, related to the padding, is visible from outside the cap-sleeve protective shirt 1300. In another embodiment, each segment of the first layer 1521 is securely fastened to the chest portion 1301 by means of adhesive. Each segment of the first layer 1521 is spaced apart from an adjacent segment of the first layer and from the edges of the cap-sleeve protective shirt 1300 by approximately 0.25 inch. Each segment of the second layer 1522 is adjacent to an inside surface of a corresponding segment of the first layer 1521. Each corresponding segment of the second layer 1522 is geometrically similar (same shape, but different size) to the segment of the first layer 1521 to which it corresponds. Each corresponding segment of the second layer 1522 is centered upon and secured to the segment of the first layer 1521 to which it corresponds. In one embodiment, each corresponding segment of the second layer 1522 is stitched to the segment of the first layer 1521 to which it corresponds. In another embodiment, each corresponding segment of the second layer 1522 is stitched to the lining of the chest portion 1301 through the first layer 1521. In still another embodiment, each corresponding segment of the second layer 1522 is secured to the segment of the first layer 1521 to which it corresponds by means of adhesive. Each segment of the first layer 1521 has a length and a width. Each corresponding segment of the second layer 1522 has a length and a width that is smaller than the length and the width of the segment of the first layer 1521 to which it corresponds. In one embodiment, each corresponding segment of the second layer 1522 has a length and a width that is 0.5 inch smaller than the length and the width of the segment of the first layer 1521 to which it corresponds. In one embodiment, each layer 1521 and 1522 of the padding has a thickness of 3 mm. In one embodiment, the padding is neoprene.

The chest portion 1301 includes a plurality of pockets—one pocket for each segment—on the side of the chest portion 1301 that is closest to a wearer of the cap-sleeve protective shirt 1300. The lining of the chest portion 1301 forms one side of each pocket and an additional fabric forms the other side of each pocket. In one embodiment, the additional fabric is of a same type as the garment material.

One segment of the clavicle/collarbone guard 1510 is disposed within each of the inner pockets.

FIG. 16 is a plan view of inside of a cap-sleeve portion 1302 of the cap-sleeve protective shirt 1300, showing a cap-sleeve pad 1606. A centerline 1303 of the cap-sleeve portion 1302 corresponds to a middle of a shoulder of a wearer when the cap-sleeve protective shirt 1300 is worn in a typical manner. The cap-sleeve pad 1606 is fastened to a side of the cap-sleeve portion 1302 that is closest to a wearer when the cap-sleeve protective shirt 1300 is worn in a typical manner. The cap-sleeve pad 1606 is positioned such that at least some of it is on each side of the centerline shown in FIG. 16. The left side of FIG. 16 corresponds to the back side (when worn) of the cap-sleeve portion 1302, and the right side of FIG. 16 corresponds to the front side (when worn) of the cap-sleeve protective shirt. Therefore, FIG. 16 illustrates that most of the cap-sleeve pad 1606 is under the front side of the cap-sleeve portion 1302. The cap-sleeve portion 1302 is lined, and the cap-sleeve pad is sewn to the lining. In one embodiment, each layer of the cap-sleeve pad 1606 has a thickness of 3 mm. In one embodiment, the cap-sleeve pad 1606 is neoprene. The cap-sleeve pad 1606 has a length that is approximately a length of the cap-sleeve portion 1302. In FIG. 16, a bottom-front edge 1309 of the cap-sleeve portion 1302 is indicated. Although not shown, the cap-sleeve protective shirt 1300 also comprises another instance of the cap-sleeve pad 1606 at the cap-sleeve portion 1303.

Figures 17, 18:
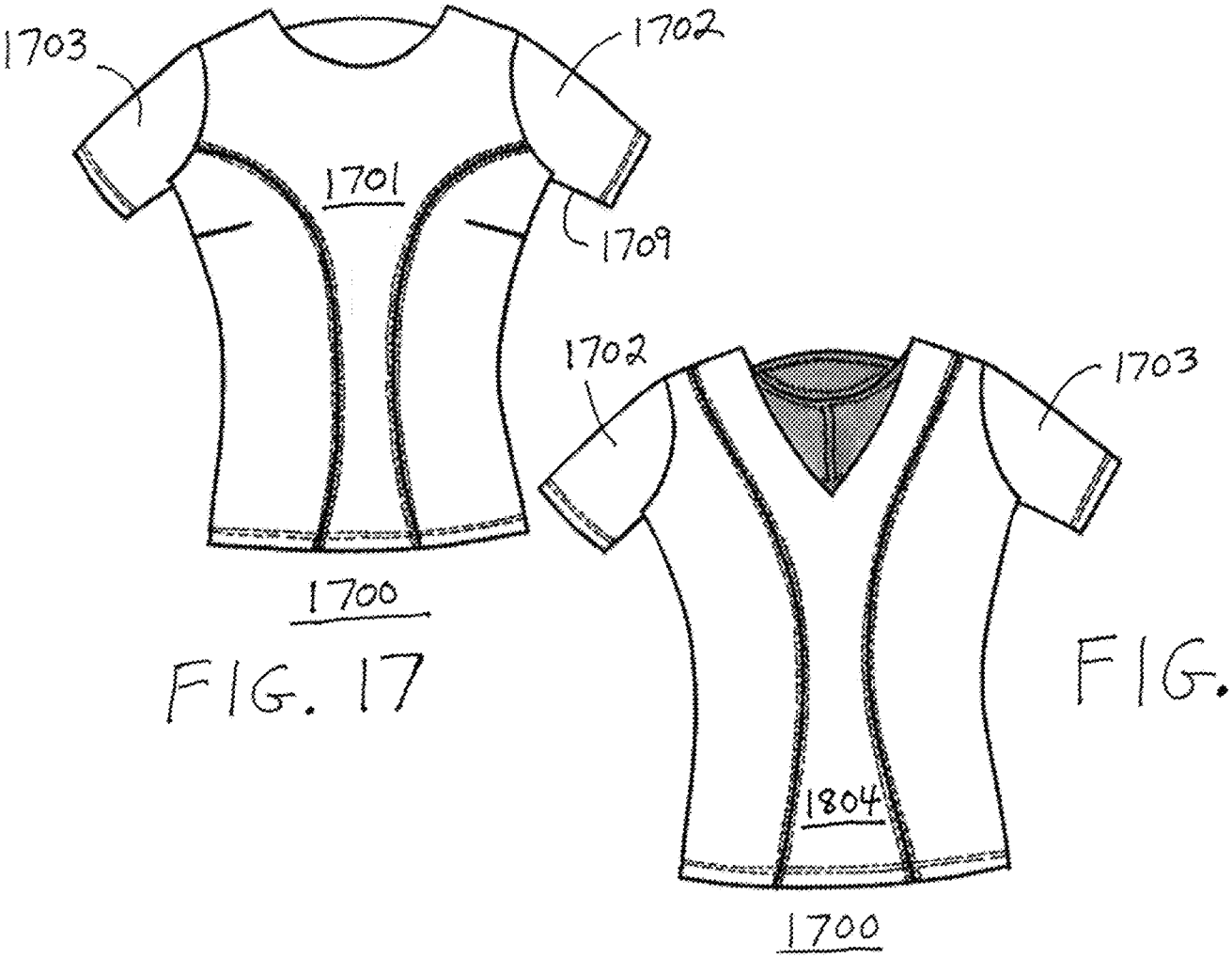
FIG. 17 is a front view of a short-sleeve protective shirt, in accordance with still another embodiment of the invention.
FIG. 18 is a rear view of the short-sleeve protective shirt of FIG. 17.

FIG. 17 is a front view of a short-sleeve protective shirt 1700, in accordance with still another embodiment of the invention. The short-sleeve protective shirt 1700 comprises a chest portion 1701 and short-sleeve portions 1702 and 1703. In FIG. 17, a bottom-front edge 1709 of the short-sleeve portion 1702 is indicated.

FIG. 18 is a rear view of the short-sleeve protective shirt 1700. The short-sleeve protective shirt 1700 comprises a back portion 1804. In one embodiment, the back portion 1804 lacks any cut-out portion. The chest portion 1701, the short-sleeve portions 1702 and 1703, and the back portion 1804 are sewn together to form a shirt, as shown in FIGS. 17 and 18.

FIG. 19 is a plan view of inside of the chest portion 1701 of the short-sleeve protective shirt 1700, showing a neck pad 1901 and a clavicle/collarbone guard 1904. The neck pad 1901 comprises a single layer of padding. The chest portion 1701 comprises a neck pocket 1905 formed by and between the garment material. The clavicle/collarbone guard 1904 comprises a plurality of segments 1911-1914. Each segment comprises two layers of padding.

FIG. 20 is a plan view of inside of short-sleeve portion 1702 of the short-sleeve protective shirt 1700, showing a short-sleeve pad 2008. The short-sleeve portion 1702 has a length that is longer than the length of the cap-sleeve portion 1302; therefore, the short-sleeve portion 1702 extends substantially beyond the short-sleeve pad 2008. The left side of FIG. 20 corresponds to the back of the short-sleeve protective shirt 1700, and the right side of FIG. 20 corresponds to the front of the short-sleeve protective shirt. The short-sleeve pad 2008 is securely fastened to an inside surface of the short-sleeve portion 1702. In FIG. 20, a bottom-front edge 1709 of the short-sleeve portion 1702 is indicated. Although not shown, the short-sleeve protective shirt 1700 also comprises another instance of the short-sleeve pad 2008 at the short-sleeve portion 1703.

Except for length of sleeves, the short-sleeve protective shirt 1700 is similar to the cap-sleeve protective shirt 1300 described hereinabove; therefore, the short-sleeve protective shirt will not be described in further detail.

Figure 21:
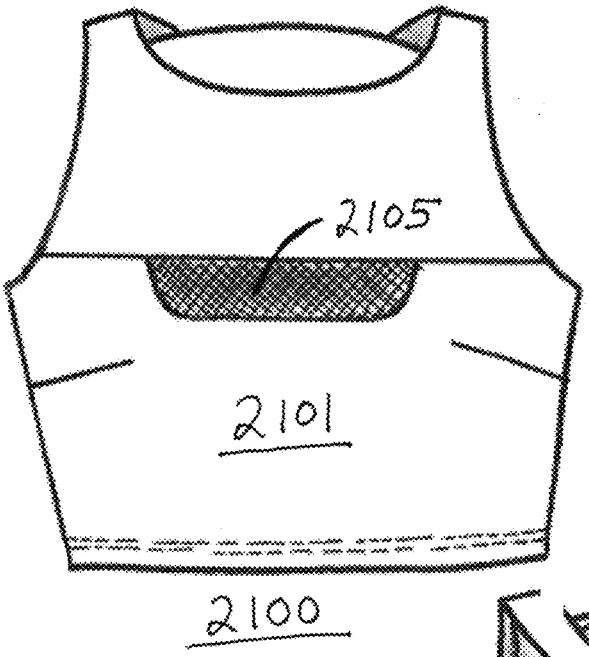
FIG. 21 is a front view of a tank-top protective shirt, in accordance with yet another embodiment of the invention.

FIG. 21 is front view of a tank-top protective shirt 2100, in accordance with yet another embodiment of the invention. The tank-top protective shirt 2100 comprises a chest portion 2101. In one embodiment, the chest portion 2101 comprises cut-out portion 2105. At the cut-out portion 2105, the garment material is replaced with power mesh fabric.

Figure 22:
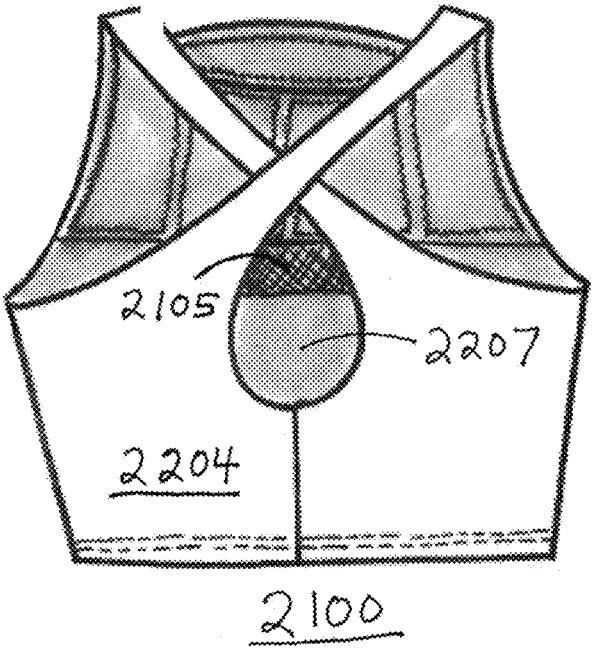
FIG. 22 is a rear view of the tank-top protective shirt of FIG. 21.

FIG. 22 is a rear view of the tank-top protective shirt 2100. The tank-top protective shirt 2100 comprises a back portion 2204. In one embodiment, the back portion 2204 comprises a tear drop portion 2207 that lacks any garment material. The chest portion 2101 and the back portion 2204 are sewn together to form a shirt, or tank top, as shown in FIGS. 21 and 22.

Figure 23:
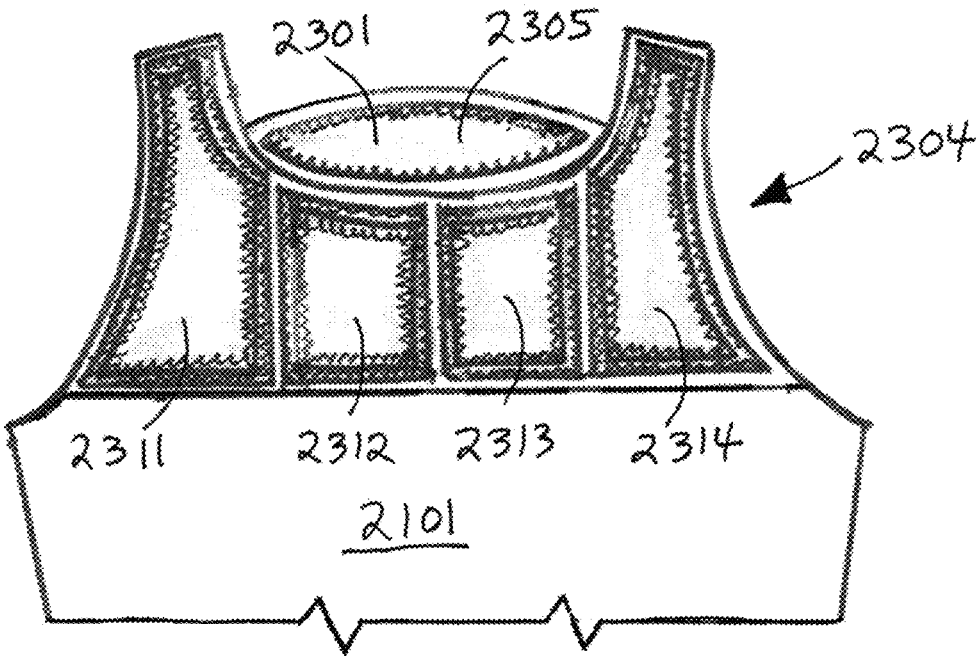
FIG. 23 is a plan view of inside of a chest portion of the tank-top protective shirt of FIG. 21, showing padding.

FIG. 23 is a plan view of inside of the chest portion 2101 of the tank-top protective shirt 2100, showing a neck pad 2301 and a clavicle/collarbone guard 2304. The neck pad 2301 comprises a single layer of padding. The chest portion 2101 comprises a neck pocket 2105 formed by and between the garment material. The clavicle/collarbone guard 2304 comprises a plurality of segments 2311-2314. Each segment comprises at least one layer of padding. In one embodiment, each segment comprises two layers of padding.

Except for the fact that the tank-top protective shirt 2100 lacks the cap-sleeve pad 1606 and the cap-sleeve portions 1302 and 1303, in many respects the tank-top protective shirt 2100 is similar to the cap-sleeve protective shirt 1300 described hereinabove; therefore, the tank-top protective shirt will not be described in further detail.

Another embodiment of the invention is a sleeveless protective shirt (not shown). The sleeveless protective shirt is similar in most respects to the cap-sleeve protective shirt 1300, except that the sleeveless protective shirt lacks the cap-sleeve pad 1606, and, of course, lacks the cap-sleeve portions 1302 and 1303.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

I claim:

1. A protective shirt comprising:

a shirt made of garment material, the shirt having a center portion, two sleeve portions a neck portion, an inner surface and an outer surface, wherein a section of a front portion of the shirt defines a clavicle/collarbone area; and a continuous piece of cushioning material with a length, a width, and a depth, fastened to the inner surface and restricted to the clavicle/collarbone area, wherein a portion of the continuous piece of cushioning material overlays clavicles of a user when the shirt is being worn by the user, the continuous piece of cushioning material formed thicker in the depth extending along a direction perpendicular to the front portion of the shirt near the center portion of the shirt and thinner in the depth moving from the center portion towards the two sleeve portions of the shirt, wherein a thickness of the continuous piece of cushioning material is greater than a thickness of the garment material;

wherein the continuous piece of cushioning material symmetrically extends from a center point below a top of the shirt to a left side and a right side of the shirt, defining an arc from a distal end of a left clavicle to the distal end of a right clavicle when worn by the user, and wherein the continuous piece of cushioning material and the garment material at the clavicle/collarbone area form a clavicle/collarbone guard.

2. The protective shirt of claim 1, wherein the cushioning material is one of synthetic rubber, neoprene and plastic.

3. The protective shirt of claim 1, wherein the cushioning material is releasably, securely fastened to the inner surface by stitching.

4. The protective shirt of claim 1, wherein the shirt is a tank top.

5. The protective shirt of claim 1, wherein the shirt includes a set of cap sleeves.

6. The protective shirt of claim 1, wherein the shirt includes a set of short sleeves.

7. The protective shirt of claim 1, wherein the shirt includes a set of long sleeves.

8. The protective shirt of claim 1, wherein the shirt is a sleeveless shirt.

9. The protective shirt of claim 1, wherein the garment material is made of one of nylon and spandex, or both.

10. The protective shirt of claim 1, wherein the continuous piece of cushioning material has an area that corresponds to the clavicle/collarbone area of a user when the shirt is being worn by the user.

11. The protective shirt of claim 10, wherein the continuous piece of cushioning material has a shape and size that corresponds to the clavicle/collarbone area of a user when the shirt is being worn by the user.

12. The protective shirt of claim 11, wherein the continuous piece of cushioning material has a shape and size that is limited to the clavicle/collarbone area of a user when the shirt is being worn by the user.

13. The protective shirt of claim 1, wherein the continuous piece of cushioning material is formed of foam material, the thicker in the depth extending along the direction perpendicular to the front portion of the protective shirt towards the neck portion and thinner of the foam material moving away from the neck portion.

14. The protective shirt of claim 1, wherein the portion of the continuous piece of cushioning material also overlays a gap between clavicles of the user when the shirt is being worn by the user.

15. A protective shirt, comprising:

a chest portion comprising garment material and including a center portion, two sleeve portions, a neck portion, and a lining on a side of the chest portion that is closest to a wearer of the protective shirt;

at least one layer of neoprene with a length, a width, and a depth, securely fastened to the lining, the at least one layer of neoprene extending from a left side of the chest portion to a right side of the chest portion and restricted to a clavicle/collarbone area of the protective shirt overlaying clavicles of the wearer of the protective shirt when worn, the at least one layer of neoprene formed thicker in the depth extending along a direction perpendicular to the front portion of the shirt near the center portion of the shirt and thinner moving from the center portion towards the two sleeve portions, the at least one layer of neoprene having a thickness greater than a thickness of the garment material; and a back portion comprising the garment material, wherein the back portion is stitched to the chest portion to form a shirt, wherein the at least one layer of neoprene has a symmetrical shape and is securely fastened to the lining at a location such that the at least one layer of neoprene symmetrically extends from a center point to the left side of the chest portion and the right side of the chest portion, defining an arc from a distal end of a left clavicle to the distal end of a right clavicle when worn by the user.

16. The protective shirt of claim 15, wherein the at least one layer of neoprene includes a plurality of spaced-apart segments.

17. The protective shirt of claim 15, including:

each sleeve portion comprising the garment material and including the lining on a side of each sleeve portion that is closest to a wearer of the protective shirt; and at least one layer of neoprene securely fastened to the lining of each sleeve portion, wherein the two sleeve portions are stitched to the chest portion and to the back portion to form a shirt with sleeves.

18. The protective shirt of claim 15, including a neck pad, affixed to a top of the chest portion, the neck pad made of neoprene.

19. The protective shirt of claim 15, wherein a portion of the at least one layer of neoprene overlays a center of the clavicle/collarbone area of a wearer of the protective shirt.

20. The protective shirt of claim 15, wherein the at least one layer of neoprene has a shape and size that corresponds to the clavicle/collarbone area of the wearer of the protective shirt.

21. The protective shirt of claim 15, wherein the at least one layer of neoprene also extends from the left side of the chest portion to the right side of the chest portion including at an area of the protective shirt between clavicles of the wearer of the protective shirt.

* * * * *